US008967273B2

(12) United States Patent
Ray et al.

(10) Patent No.: US 8,967,273 B2
(45) Date of Patent: Mar. 3, 2015

(54) SYSTEM FOR DETECTING, CONTAINING AND REMOVING HYDROCARBON LEAKS IN A SUBSEA ENVIRONMENT

(71) Applicant: ConocoPhillips Company, Houston, TX (US)

(72) Inventors: Anthony W. Ray, Brookshire, TX (US); Randall S. Shafer, Houston, TX (US); Ravi Aurora, Sugar Land, TX (US); Dominique P. Berta, Flower Mound, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 14/200,584

(22) Filed: Mar. 7, 2014

(65) Prior Publication Data

US 2014/0262314 A1 Sep. 18, 2014

Related U.S. Application Data

(60) Provisional application No. 61/780,425, filed on Mar. 13, 2013.

(51) Int. Cl.

| | |
|---|---|
| ***E21B 33/037*** | (2006.01) |
| ***E21B 47/10*** | (2012.01) |
| ***E21B 33/035*** | (2006.01) |

(52) U.S. Cl.

CPC ..... *E21B 47/1025* (2013.01); *E21B 33/035* (2013.01)

USPC ..... 166/364; 166/337; 405/249

(58) Field of Classification Search

CPC .... E21B 33/037; E21B 43/0122; E21B 47/10

USPC ..... 166/364, 337, 356, 250.08, 66; 405/60, 405/211, 249

See application file for complete search history.

(56) References Cited

U.S. PATENT DOCUMENTS

| | | | | | |
|---|---|---|---|---|---|
| 3,063,500 | A | * | 11/1962 | Logan | 166/351 |
| 3,247,672 | A | * | 4/1966 | Johnson | 405/210 |
| 3,461,957 | A | * | 8/1969 | West | 166/351 |
| 3,592,263 | A | * | 7/1971 | Nelson | 166/356 |
| 3,703,207 | A | * | 11/1972 | Horton | 166/337 |
| 3,866,676 | A | * | 2/1975 | Burns | 166/363 |
| 4,220,421 | A | * | 9/1980 | Thorne | 405/211 |
| 4,273,472 | A | * | 6/1981 | Piazza et al. | 405/211 |
| 4,335,740 | A | * | 6/1982 | Boley | 137/364 |
| 4,519,727 | A | * | 5/1985 | Mitchell et al. | 405/204 |
| 4,558,744 | A | * | 12/1985 | Gibb | 166/335 |
| 4,692,065 | A | | 9/1987 | Suzuki et al. | |

(Continued)

FOREIGN PATENT DOCUMENTS

| | | |
|---|---|---|
| WO | 8606771 | 11/1986 |
| WO | 9515428 | 6/1995 |
| WO | 02063106 | 8/2002 |

OTHER PUBLICATIONS

Gijzel and Athmer, "Installation of the Mobile Arctic Caisson Molikpaq." Offshore Technology Conference, OTC 4942 (1985).

(Continued)

*Primary Examiner* — Matthew Buck

(74) *Attorney, Agent, or Firm* — ConocoPhillips Company

(57) ABSTRACT

A system for the detection, containment and removal of hydrocarbon leaks in a subsea environment.

14 Claims, 2 Drawing Sheets

(56) References Cited

U.S. PATENT DOCUMENTS

| | | | | |
|---|---|---|---|---|
| 5,010,957 | A * | 4/1991 | Kenner | 166/379 |
| 5,050,680 | A * | 9/1991 | Diehl et al. | 166/356 |
| 5,063,996 | A * | 11/1991 | Kenner | 166/75.11 |
| 5,176,471 | A * | 1/1993 | Frafjord et al. | 405/211 |
| 5,195,590 | A * | 3/1993 | Kenner | 166/379 |
| 5,310,286 | A * | 5/1994 | Gilbert et al. | 405/169 |
| 5,383,748 | A | 1/1995 | Waddell | |
| 5,647,295 | A | 7/1997 | Korsgaard | |
| 6,371,695 | B1 | 4/2002 | Davenport, III et al. | |
| 8,186,443 | B2 * | 5/2012 | Wolinsky | 166/364 |
| 8,196,665 | B2 * | 6/2012 | Wolinsky | 166/356 |
| 8,479,807 | B2 * | 7/2013 | Short | 166/81.1 |
| 2010/0221069 | A1 * | 9/2010 | Brinkmann et al. | 405/203 |
| 2011/0274493 | A1 * | 11/2011 | Cutts | 405/60 |
| 2012/0018165 | A1 * | 1/2012 | Crossley et al. | 166/344 |

OTHER PUBLICATIONS

Meadows and Gilbert, "Drilling and Installing Large-Diameter Caissons for Wellhead Protection," Offshore Technology Conference, OTC 6128-MS (1989).

Timco and Johnston, "Ice loads on the caisson structures in the Canadian Beaufort Sea," Cold Regions Sci. Tech., 38:185-209 (2004).

* cited by examiner

SYSTEM FOR DETECTING, CONTAINING AND REMOVING HYDROCARBON LEAKS IN A SUBSEA ENVIRONMENT

This application is a non-provisional application which claims benefit under 35 USC §119(e) of and priority to U.S. Provisional Application Ser. No. 61/780,425 filed 13 Mar., 2013, entitled "A SYSTEM FOR DETECTING, CONTAINING AND REMOVING HYDROCARBON LEAKS IN A SUBSEA ENVIRONMENT," which is incorporated by reference herein in its entirety.

FIELD OF THE INVENTION

This invention relates to a system for the detection, containment and removal of hydrocarbon leaks in a subsea environment.

BACKGROUND OF THE INVENTION

In offshore oil exploration, it is often necessary to protect subsea equipment from damage from anchors, fishing nets, ice features or other marine hazards. Equipment protruding from the sea floor in high traffic areas, such as shipping lanes or areas with submarine activity, has an inherent danger of damage to either vessels or the environment due to potential oil spills from damaged equipment.

To date, subsea drilling equipment such as blow-out preventers and well completion equipment, such as "Christmas trees," have been located at the sea floor level, leaving them exposed and susceptible to damage. The problem is particularly acute in Arctic waters where ice packs and icebergs scour the ocean floor with great force. Consequently, excavations on the ocean floor, called glory holes, have been used to enable blow-out preventers, wellheads and associated well completion equipment to be relocated below ice scour regions or to protect the wellhead from damages from anchors, fishing equipment or shipping hazards. However, glory holes can be expensive to dredge where difficult soil conditions are encountered or the water is deep. Furthermore, the protection provided against scouring by ice is imperfect, as the ice pushes a pile of rubble ahead of it as it scours the ocean floor, and little protection against anchors, fishing nets and the like is provided.

Caissons have also been utilized in the art in an effort to protect subsea equipment from marine hazards. Caissons are generally made from steel or concrete installed below the scour regions in subsea environments.

Unfortunately, even with appropriate protection of subsea equipment leakage of hydrocarbons is still a possibility.

Therefore, a need exists for containment, detection and removal of hydrocarbon leaks by creating a closed environment where leaks can be detected, contained, and mitigated to prevent hydrocarbons from reaching the environment.

SUMMARY OF THE INVENTION

In an embodiment, a system penetrating a sea bed of an Arctic subsea environment, wherein the system detects, contains and removes hydrocarbon leaks within the system, wherein hydrocarbon leaks include oil and gas, includes: (a) a hollow caisson, wherein the caisson includes walls and a floor, wherein the caisson is fabricated from any material capable of withstanding a harsh subsea environment, wherein the caisson is fabricated from steel, concrete or any combination thereof; (b) subsea equipment disposed within the caisson, wherein components of the subsea equipment penetrate the caisson; (c) a removable lid for sealing the caisson, wherein the lid creates a fluid tight seal, wherein the lid includes at least one vent, wherein the lid includes a removal port for accessing hydrocarbon leaks within the system, wherein the lid is fabricated from any material capable of withstanding a harsh subsea environment, wherein the lid is fabricated from steel, concrete or any combination thereof; (d) a primary detection means are connected to an inner surface of the lid, wherein the primary detection means detects the presence of hydrocarbon leaks within the system, wherein the primary detection means is a semiconductor or a capacitor; (e) a secondary detection means are connected to components of the subsea equipment, wherein the secondary detection means detects the presence of hydrocarbon leaks within the system, wherein the secondary detection means is either a semiconductor or a capacitor; and (f) suction means penetrating the lid through removal port, wherein the suction means removes hydrocarbon leaks from the system, wherein the suction means is a flexible suction hose.

In another embodiment, a system for detecting, containing and removing hydrocarbon leaks within the system, includes: (a) a hollow caisson penetrating a sea bed of a subsea environment; (b) subsea equipment disposed within the caisson, wherein components of the subsea equipment penetrate the caisson; (c) a removable lid for sealing the caisson, wherein the lid creates a fluid tight seal, wherein the lid includes a removal port for accessing hydrocarbon leaks within the system; (d) a primary detection means are connected to an inner surface of the lid, wherein the detection means detects the presence of hydrocarbon leaks within the system; and (e) suction means penetrating the caisson for removal of leaked hydrocarbons.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Reference will now be made in detail to embodiments of the present invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used in another embodiment to yield a still further embodiment. Thus, it is intended that the present invention cover such modifications and variations that come within the scope of the appended claims and their equivalents.

Figure 1:
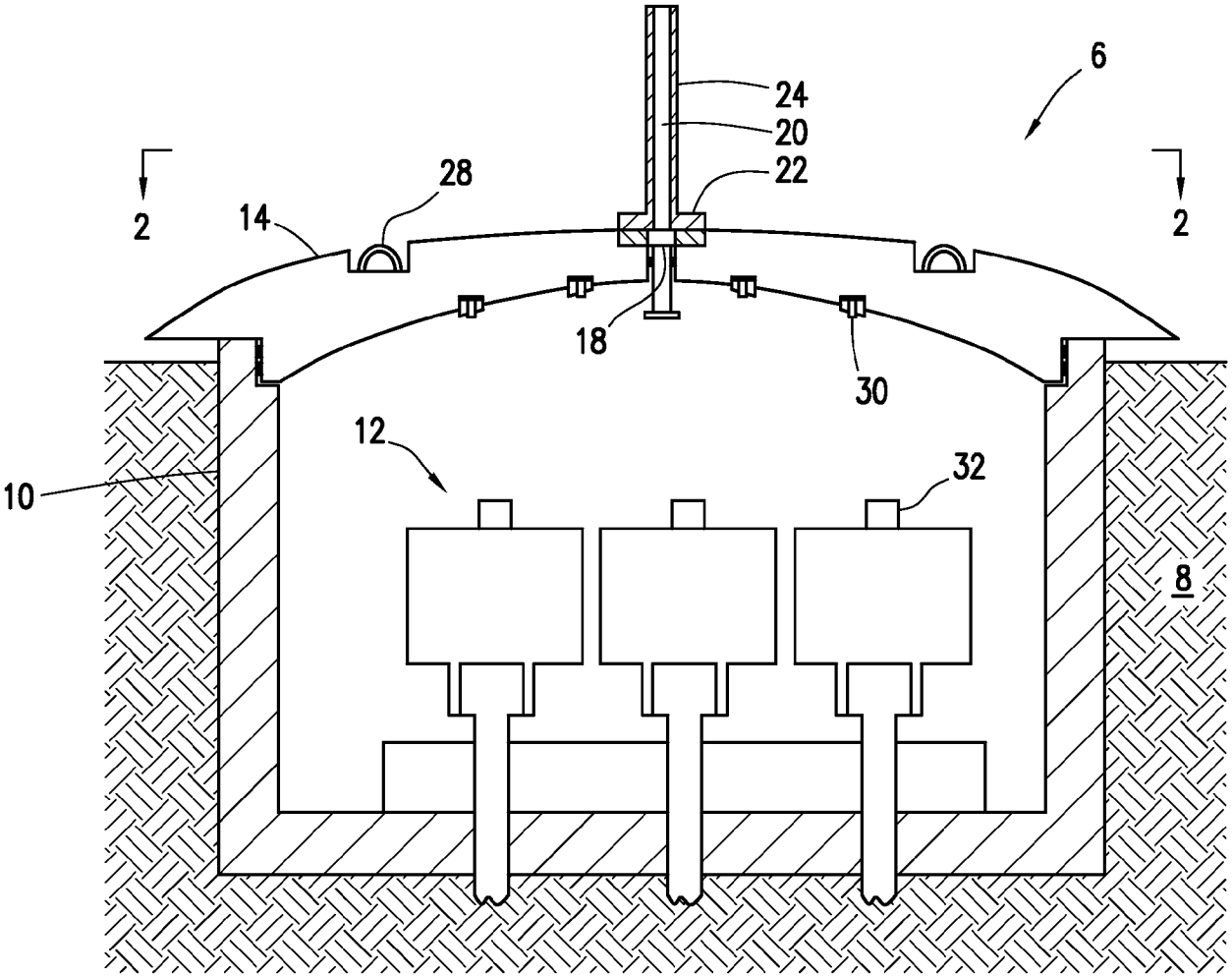
FIG. 1 is a schematic of an embodiment of the present invention.
Figure 2:
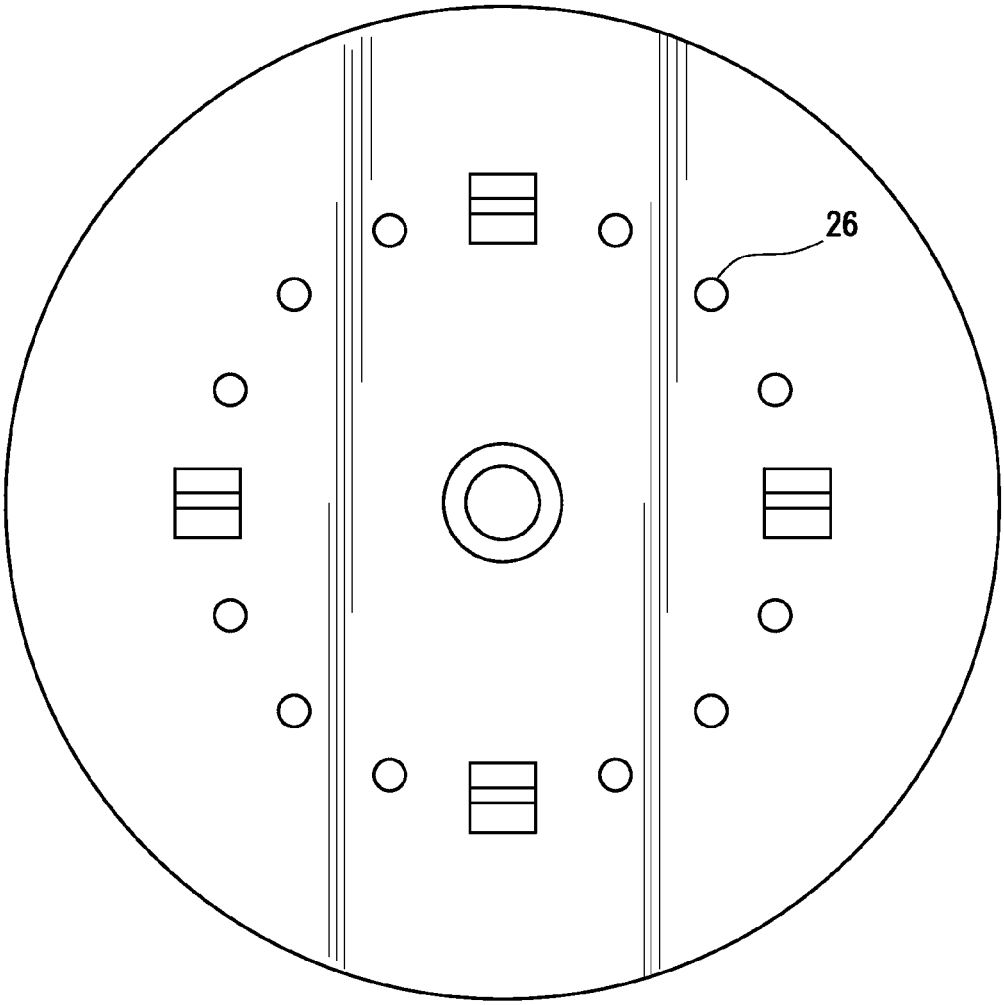
FIG. 2 is a view taken across line 2-2 in FIG. 1.

The system in accordance with the present disclosure serves to protect any wellhead equipment housed within the structure from damages; to prevent the infill of the structure with sediment being moved by ocean currents or ice; to contain and detect hydrocarbons that have been released into the system; and to remove hydrocarbon leaks within the system. Referring to FIG. 1, there is shown a subsea caisson 10 penetrating the sea bed 8 of a subsea environment 6. FIG. 1 depicts a cylindrical caisson 10, however, the structure can be any shape suitable for the intended purpose. The caisson can be fabricated from any material capable of withstanding harsh marine environments. Harsh marine environments, for example, can include ice packs, iceberg scour and anchors. Such material capable of maintaining structural integrity in harsh subsea environments can include steel, concrete or combinations thereof.

The caisson may include a floor. The caisson can be fabricated from any material capable of withstanding harsh marine environments. The floor can be fabricated from steel, concrete or combinations thereof.

The caisson 10 contains subsea equipment 12. Such subsea equipment can include, but is not limited to blow-out preventers and well completion equipment. The subsea equipment can penetrate the caisson.

A removable lid 14 forms a roof to seal the caisson 10. When attached to the caisson 10, the removable lid 14 creates a fluid tight seal to prevent the entrance of water into the system and to contain any hydrocarbon leaks within the system. The lid can be fabricated from any material capable of withstanding harsh marine environments. Ice packs, iceberg scour, anchors or other marine hazards are examples of harsh marine environments. Such material capable of maintaining structural integrity in harsh subsea environments can include concrete, steel or combinations thereof.

The lid 14 includes a removal port 22 capable of providing access to the hydrocarbon leaks contained within the system. When hydrocarbon leaks are detected within system, a plug 18 is removed from the removal port 22 in the lid 14. The hydrocarbon leak can then be discharged from the system through removal port 22 and into suction means 20. The suction means 20 allow flow from the system through a flexible riser 24 to the surface. The suction means can be a flexible hose. The suction means can be attached to the lid via a flanged connection.

The lid may include at least one vent 26 to vent. The lid may also include lifting eyes 28 for removal of the lid 14 from the caisson 10.

Primary detection means 30 may be located on the interior surface of lid 14. The primary detection means are capable of detecting the presence of hydrocarbon leaks within the system. The primary detection means can include, but are not limited to semiconductors or capacitors. A hydrocarbon sniffer is an example of a primary detection means.

Secondary detection means 32 can be included on the subsea equipment. The secondary detection means are capable of detecting the presence of hydrocarbon leaks within the system. The secondary detection means can include, but are not limited to semiconductors or capacitors. A hydrocarbon sniffer is an example of a secondary detection means.

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A system penetrating a sea bed of an Arctic subsea environment, wherein the system detects, contains and removes hydrocarbon leaks within the system, wherein hydrocarbon leaks include oil and gas, comprising:

a. a hollow caisson, wherein the caisson includes walls and a floor, wherein the caisson is fabricated from any material capable of withstanding a harsh subsea environment, wherein the caisson is fabricated from steel, concrete or any combination thereof;

b. subsea equipment disposed within the caisson, wherein components of the subsea equipment penetrate the caisson;

c. a removable lid for sealing the caisson, wherein the lid creates a fluid tight seal to prevent the entrance of water into the caisson, wherein the lid includes at least one vent, wherein the lid includes a removal port for accessing hydrocarbon leaks within the system, wherein the lid is fabricated from any material capable of withstanding a harsh subsea environment, wherein the lid is fabricated from steel, concrete or any combination thereof;

d. a primary detection means is connected to an inner surface of the lid, wherein the primary detection means detects the presence of hydrocarbon leaks within the system, wherein the primary detection means is a first hydrocarbon sniffer;

e. a secondary detection means is connected to components of the subsea equipment, wherein the secondary detection means detects the presence of hydrocarbon leaks within the system, wherein the secondary detection means is a second hydrocarbon sniffer; and f. suction means penetrating the lid through the removal port, wherein the suction means removes hydrocarbon leaks from the system, wherein the suction means is a flexible suction hose.

2. A system for detecting, containing and removing hydrocarbon leaks within the system, comprising:

a. a hollow caisson penetrating a sea bed of a subsea environment;

b. subsea equipment disposed within the caisson, wherein components of the subsea equipment penetrate the caisson;

c. a removable lid for sealing the caisson, wherein the lid creates a fluid tight seal to prevent the entrance of water into the caisson, wherein the lid includes a removal port for accessing hydrocarbon leaks within the system;

d. a primary detection means is connected to an inner surface of the lid and is a hydrocarbon sniffer, wherein the detection means detects the presence of hydrocarbon leaks within the system; and e. suction means penetrating the caisson for removal of leaked hydrocarbons.

3. The system according to claim 2, wherein the subsea environment is an Arctic environment.

4. The system according to claim 2, wherein hydrocarbon leaks include oil and gas.

5. The system according to claim 2, wherein the caisson includes a floor.

6. The system according to claim 5, wherein the floor is fabricated from any material capable of withstanding a harsh subsea environment.

7. The system according to claim 6, wherein the floor is fabricated from steel, concrete or any combination thereof

8. The system according to claim 2, wherein the caisson is fabricated from any material capable of withstanding a harsh subsea environment.

9. The system according to claim 8, wherein the caisson is fabricated from steel, concrete or any combination thereof.

10. The system according to claim 2, wherein the lid includes at least one vent.

11. The system according to claim 2, wherein the lid is fabricated from any material capable of withstanding a harsh subsea environment.

12. The system according to claim 11, wherein the lid is fabricated from steel, concrete or any combination thereof.

13. The system according to claim 2, wherein the suction means is a flexible suction hose.

14. The system according to claim 2, wherein a secondary detection means is connected to components of the subsea equipment and detects the presence of hydrocarbon leaks within the system.

* * * * *